US006807838B2

(12) United States Patent
Iwaya

(10) Patent No.: US 6,807,838 B2
(45) Date of Patent: Oct. 26, 2004

(54) PRESS DIE

(75) Inventor: Jiro Iwaya, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 0 days.

(21) Appl. No.: 09/998,214

(22) Filed: Dec. 3, 2001

(65) Prior Publication Data

US 2002/0068108 A1 Jun. 6, 2002

(30) Foreign Application Priority Data

Dec. 6, 2000 (JP) ..... 2000-370803

(51) Int. Cl.[7] ..... B21D 24/04
(52) U.S. Cl. ..... 72/350; 72/347
(58) Field of Search ..... 72/350, 351, 347; 76/107.1

(56) References Cited

U.S. PATENT DOCUMENTS

| | | | | | |
|---|---|---|---|---|---|
| 2,971,644 | A | * | 2/1961 | Sejournet | 72/43 |
| 3,664,172 | A | * | 5/1972 | Cvacho | 72/350 |
| 3,789,649 | A | * | 2/1974 | Clowes | 72/350 |
| 5,069,089 | A | * | 12/1991 | Yasuno et al. | 76/107.1 |
| 5,070,425 | A | * | 12/1991 | Inumochi | 360/135 |
| 5,398,572 | A | * | 3/1995 | Hashimoto et al. | 76/107.1 |
| 5,644,943 | A | * | 7/1997 | Lanz | 72/348 |
| 5,701,777 | A | * | 12/1997 | Yamanaka et al. | 72/350 |

FOREIGN PATENT DOCUMENTS

| | | | | | |
|---|---|---|---|---|---|
| GB | 2 238 266 | A | * | 5/1991 | |
| JP | 03114620 | A | * | 5/1991 | B21D/37/20 |
| JP | 03138032 | A | * | 6/1991 | |
| JP | 04228231 | A | * | 8/1992 | B21D/37/20 |
| JP | 2711156 | | | 10/1997 | |
| JP | 2815417 | | | 8/1998 | |
| JP | 2857497 | | | 11/1998 | |
| JP | 2002336915 | A | * | 11/2002 | B21D/24/00 |
| SU | 1006012 | A | * | 3/1983 | B21J/1/04 |
| SU | 1606233 | | * | 11/1990 | |

* cited by examiner

*Primary Examiner*—Lowell A. Larson
(74) *Attorney, Agent, or Firm*—Oblon, Spivak, McClelland, Maier & Neustadt, P.C.

(57) ABSTRACT

A press die composed of an upper die having a concave part (with the peripheral surface of the opening of said concave part functioning as a first blank pressing face), a lower die having a convex part (to form the blank into a desired form in cooperation with said concave part), and a blank holder (which has a second blank pressing face), said press die working in such a way that said first blank pressing face and said second blank pressing face hold a blank between them while permitting it to flow into said concave part during pressing, characterized in that at least either of said first blank pressing face and said second blank pressing face has a roughened surface with a plurality of striated projections which are formed in the direction inclined in a range of −25° to +25° (preferably approximately parallel) toward the circumferential direction of the edge of the opening of said concave part.

The press die permits the blank to slide easily and hence prevents the blank from decreasing in thickness during press forming.

7 Claims, 4 Drawing Sheets

PRESS DIE

BACKGROUND OF THE INVENTION

1. Field of the Invention

The present invention relates to a press die which facilitates the smooth feeding of a blank (a piece of metal sheet cut to a size adequate for forming) at the time of press-forming automotive outer and inner panels.

2. Description of the Related Arts

For improved safety and environmental protection, automobile manufacturers have been attempting to make automotive bodies stronger and lighter by replacing conventional steel sheets with high-strength steel sheets or light-metal sheets (such as aluminum alloy sheets).

Unfortunately, high-strength steel sheets and light metal sheets usually have the disadvantage of being poor in press-formability. They easily become thin and crack during press-forming, and this prevents their general acceptance.

There have been proposed several techniques for preventing cracking in press-forming. It has been common practice to apply highly-lubricating rust preventing oil to blanks, to form solid lubricating film on blanks, and to use so-called press oil. These means are intended to prevent thickness reduction, to promote the material flow into a concave part, and to help the blank to readily slide on the surface of the blank holder.

On the other hand, there have been proposed several techniques for controlling the surface roughness of the press die, instead of applying press oil to blanks, in order to improve the slidability of blanks. For example, recent techniques disclosed in Japanese Patent Nos. 2711156, 2815417, and 2857497 are designed to roughen the blank holder surface by intentionally leaving machining marks, thereby reducing the sliding resistance of blanks. However, nothing is mentioned about the desirable direction of machining marks.

OBJECT AND SUMMARY OF THE INVENTION

It is an object of the present invention to provide a new press die which permits the blank to readily slide, and hence prevents the blank from becoming thin, and offers good press-formability.

The present invention is directed to a press die comprising: a first die having a concave part, said concave part having an opening, the peripheral surface of the opening functioning as a first blank pressing face; a second die having a convex part; said second die forming a blank into a desired form in cooperation with said concave part; and a blank holder having a second blank pressing face, said blank holder working in such a way that said first blank pressing face and said second blank pressing face hold the blank between them while permitting it to flow into said concave part during pressing, wherein at least either of said first blank pressing face and said second blank pressing face has a roughened surface with a plurality of striated projections which are formed in the direction inclined in a range of −25° to +25° toward the circumferential direction of the edge of the opening of said concave part.

The present invention produces the following effects. The actual contact area between the blank and the first or second blank pressing face is reduced because the blank pressing face is roughened with a plurality of striated projections formed thereon. The reduced contact area causes the blank to experience less sliding resistance. The striated projections are formed in the direction inclined within ±25° toward the circumferential direction of the edge of the opening of the concave part. Therefore, the blank comes into discontinuous contact with the blank pressing face. This prevents the blank from being stretched, deformed, and cracked during press forming. The resulting formed product has an accurate thickness.

The roughened face with striated projections should preferably have a surface roughness (Ra) of 0.02–60 $\mu$m measured in the direction perpendicular to the circumferential direction of the edge of the opening of the concave part. Such a rough surface is effective in reducing sliding resistance further.

DESCRIPTION OF THE PREFERRED EMBODIMENTS

The preferred embodiments of the invention will be described in more detail with reference to the accompanying drawings.

Figure 1:
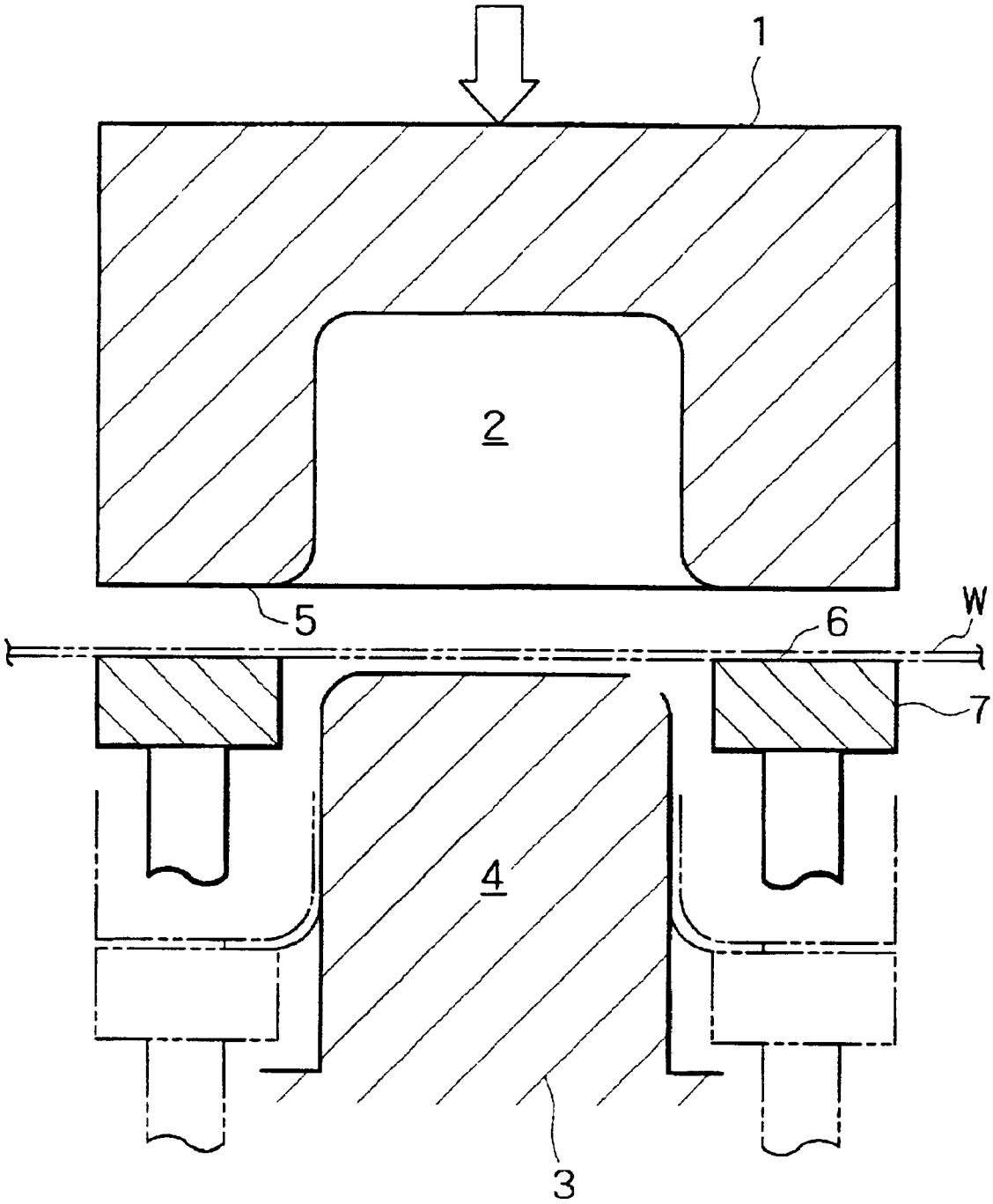
FIG. 1 is a sectional view showing the press die pertaining to the present invention.

FIG. 1 shows a press die pertaining to the present invention. It consists of an upper die 1, a lower die (punch) 3, and a blank holder 7. The upper die 1 has a concave part 2 which opens downward. The upper die 1 is movable toward and away form the lower die 3. The lower die 3 has a convex part 4 which forms the blank W into a desired shape in cooperation with the concave part 2 as the upper die 1 approaches. The blank holder 7 is arranged around the lower die 3, such that a blank W is held under pressure between the first blank pressing face 5 and the second blank pressing face 6, the former being formed on the periphery of the opening of the concave part in the upper die 1, and the latter being formed on the blank holder 7.

In operation, the upper die 1 is brought down in opposition to the upward actuating force of the blank holder 7. As the upper die 1 goes down, the blank W placed on the blank holder 7 is held between the first blank pressing face 5 and the second blank pressing face 6. Thus, the blank W flows into the concave part 2 so that it is formed into a desired shape defined by the concave part 2 and the convex part 4. Incidentally, the blank W is a steel sheet or an aluminum alloy sheet.

Figure 2A:
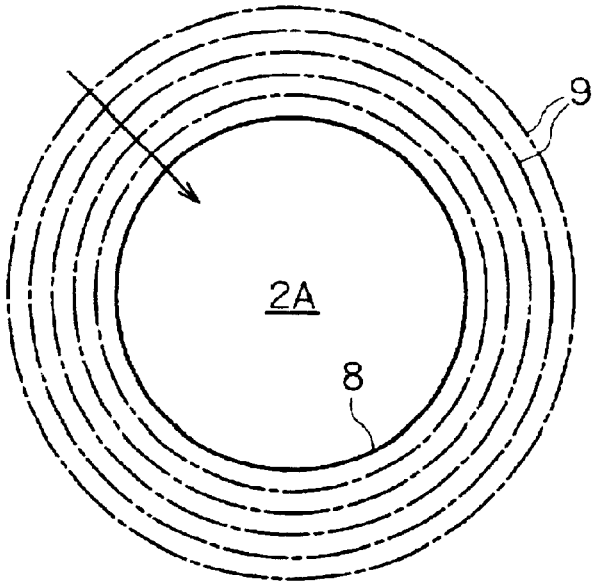
FIG. 2 is a plan view showing the first blank pressing face which constitutes the periphery of the opening of the concave part formed in the upper die.
Figure 2B:
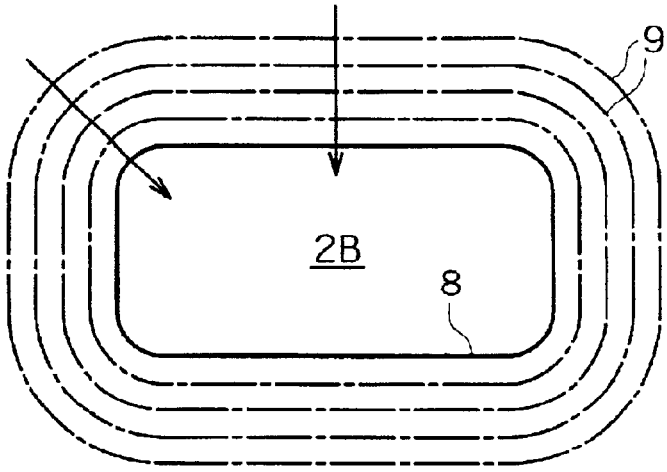

As shown in FIG. 2, the concave part 2 may have a round cross section (2A) for cupping drawing or a square cross section (2B) for rectangular drawing. Also as shown in FIG. 2, the first blank pressing face 5 and/or the second blank pressing face 6 has a number of striated projections 9 formed thereon. The striated projections 9 run in the direction parallel to the edge 8 of the opening of the concave part 2A or 2B. (The direction means the lengthwise direction if the edge is linear and the tangential direction if the edge is curved.) In other words, the direction is perpendicular to the edge 8 of the opening, as indicated by an arrow in the direction of which the blank flows. In FIG. 2, only the center line of the direction of the striated projections 9 is shown for convenience.

Figure 3:
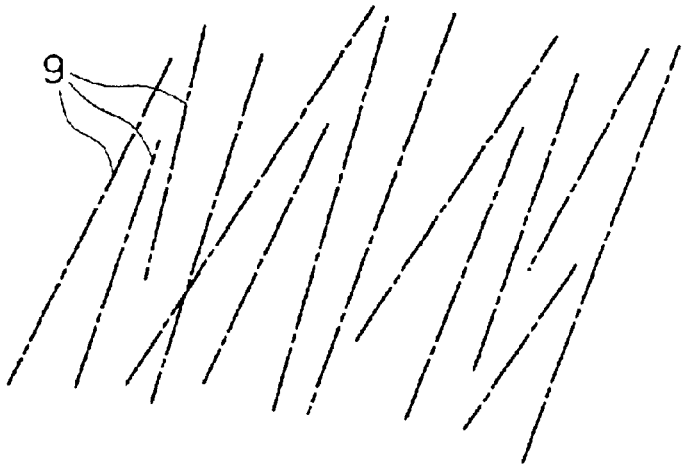
FIG. 3 is a partial plan view showing the blank pressing face on which striated projections are formed in various working directions.

The striated projections 9 may be formed in a direction either parallel (or approximately parallel) to or inclined toward the peripheral direction of the edge of the opening of the concave part 2. The angle of inclination is less than ±25°, preferably less than ±15°, more preferably less than ±10°. In this case, individual striated projections 9 may have any angle of inclination (within the above-specified range) so that the striated projections as a whole form a rough surface, as shown in FIG. 3. (The chain line in FIG. 3 indicates the center line of each striated projection.)

The striated projections 9 are formed such that the cross section is a triangle with a flat extended base (A), a triangle (B), a truncated triangle (C), a peak (D), or a truncated peak (E), as shown in FIG. 4. The blank pressing face having the striated projections may have any adequate surface treatment such as chromium plating or case hardening. These striated projections may be formed by working with a ball end mill or grindstone or by manual grinding with an abrasive cloth or paper.

The surface with a number of striated projections 9 should preferably have a surface roughness of 0.02–60 μm (in terms of Ra or the center line average height according to JIS B0601) which is measured in the direction perpendicular to the circumferential direction of the edge of the opening. With a surface roughness smaller than 0.02 μm, the striated projections readily wear out, losing their effect of reducing sliding resistance. With a surface roughness larger than 60 μm, the striated projections rather increase sliding resistance, resulting in a higher production cost. A preferred surface roughness is about 0.1–40 μm in consideration of improved sliding characteristics, durability, and processing cost. Forming the striated projections by cutting is effective in reducing the die production cost. In this case the value of Ra should preferably be 2–30 μm and the height of projection should preferably be about 0.01–0.2 mm for easy working.

The foregoing embodiment illustrates a die in which the striated projections are formed on both the first blank pressing face 5 and the second blank pressing face 6. In practice, the striated projections 9 may be formed on either face. In addition, the striated projections 9, which should be formed, in principle, parallel to the edge of the opening of the concave part 2, may be formed also in the area along which the blank flows, as in the case of draw-bending.

EXAMPLES

The invention will be described in more detail with reference to the following examples, which are not intended to restrict the scope thereof.

Example 1

Figure 5:
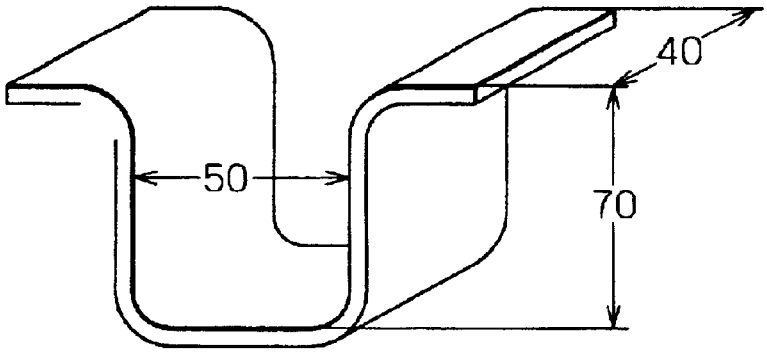
FIG. 5 is a sectional view showing a U-shaped member formed by draw-bending in Examples.

This example demonstrates the effect of striated projections in the deep-drawing of a U-shaped member (measuring in millimeters as shown FIG. 5) by a die shown in FIG. 1 from three kinds of ordinary cold-rolled steel sheet (1.4 mm thick) differing in strength as indicated below. Incidentally, the blank pressing force differed from one species of blank to another.

Steel Sheet A: (Mild Steel) . . . tensile strength: 336 MPa, elongation: 40%

Steel Sheet B: . . . tensile strength: 454 MPa, elongation: 34%

Steel Sheet C: . . . tensile strength: 648 MPa, elongation: 24[{]ps

Figure 4A:
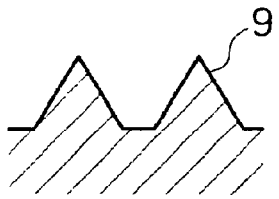
FIG. 4 is a partial sectional view showing various kinds of striated projections.
Figure 4B:
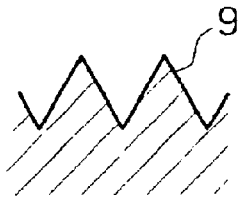
Figure 4C:
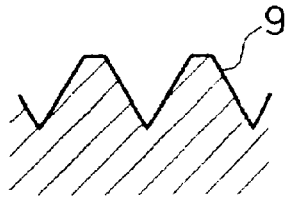
Figure 4D:
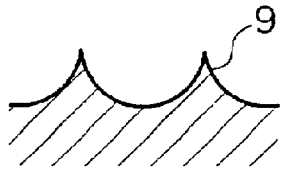
Figure 4E:
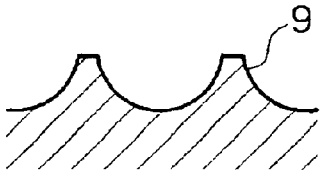

The die used for drawing is characterized in that the first blank pressing face (on the upper die) and the second blank pressing face (on the blank holder) are roughened with a large number of striated projections which run in the direction parallel to, perpendicular to, or inclined 45° to the edge of the opening of the concave part into which the blank flows. The striated projections were formed by cutting with a ball end mill (30 mm in diameter) which was fed in the direction in which the striated projections run and was also fed in the lateral direction at a prescribed pitch (1.3 mm). The resulting striated projections have a peak-like cross section (with a height of 0.014 mm) as shown in FIG. 4(D). The surface roughness (Ra) measured in the direction perpendicular to the edge of the opening was 2.7 mm.

Comparative Example 1

Draw-bending was performed in the same way as in Example 1 except that the press die was replaced by the one in which the first and second blank pressing faces were roughened by grinding to the same surface roughness as that in Example 1. Grinding was carried out in the spiral direction to avoid directionality in the usual way.

Figure 6:
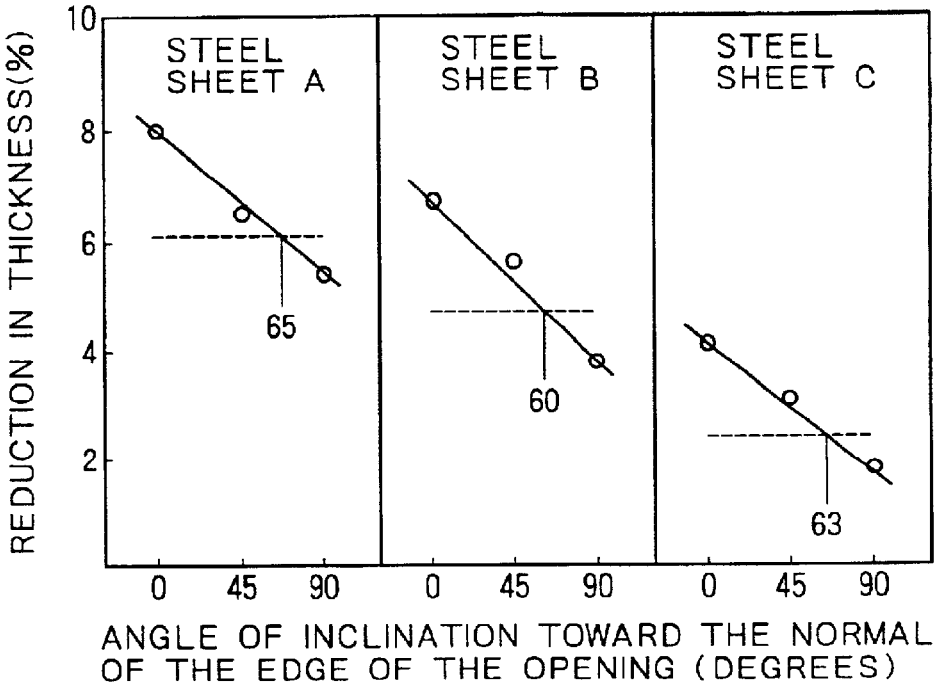
FIG. 6 is a graph showing the relation between the direction in which striated projections are formed and the ratio of thickness reduction of the formed product in Examples.

In Example 1 and Comparative Example 1, the slidability of blanks in draw-bending was evaluated in terms of reduction (%) in thickness of the vertical wall of the formed product, in view of the fact that the vertical wall after forming becomes thin variously depending on sliding resistance. The results are shown in FIG. 6. Broken lines in FIG. 6 represent the results in Comparative Example 1. It is to be noted that reduction in thickness remains constant because the striated projections have no directionality.

It is noted from FIG. 6 that the reduction in thickness decreases in proportion to the decreasing angle between the direction of striated projections and the normal of the edge of the opening of the concave part. It is also noted that the die used in Example 1 gave the slidability and the reduction in thickness which are comparable to or superior to the ordinary press die so long as the striated projections are formed in the direction within ±25° from the normal of the edge of the opening of the concave part. It is further noted that the reduction in thickness becomes more significant as the strength of steel sheet increases.

Example 2

The above-mentioned steel sheet (C) was formed into a U-shaped product by draw-bending by means of a die in which the striated projections on the first and second blank pressing faces varied in surface roughness (Ra) from 0.02 μm to 100 μm (measured in the direction perpendicular to the edge of the opening). The striated projections with Ra smaller than 0.2 μm were formed by using an emery paper (#240–#1000), and the striated projections with Ra larger than 0.2 μm were formed continuously by using a ball end mill (10–30 mm in diameter), with a feed pitch of 1–4 mm. The blanks were examined for slidability in the same way as mentioned above. The results are shown in FIG. 7.

Figure 7:
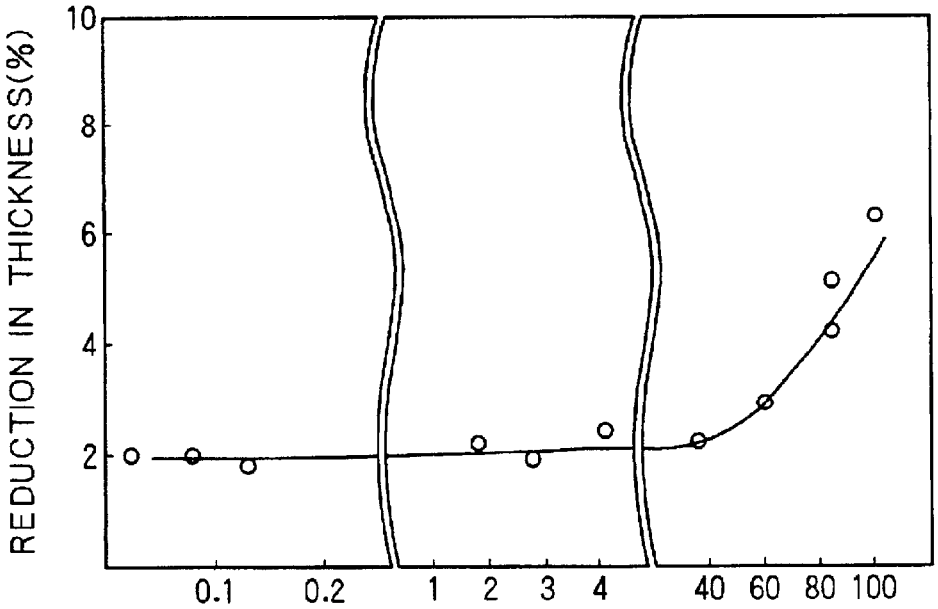
FIG. 7 is a graph showing the relation between the ratio of thickness reduction of the formed product and the center line average height of the rough surface having striated projections in Examples.

It is noted from FIG. 7 that the reduction in thickness remains almost constant while the surface roughness (Ra) of the striated projections is smaller than 60 μm (to be more strict, smaller than 40 μm), but increases as it exceeds 60 μm. This Example showed that the striated projections produce the effect of reducing sliding resistance even though the surface roughness (Ra) is as small as 0.02 μm.

What is claimed is:

1. A press die comprising:

a first die having a concave part, said concave part having an opening, the peripheral surface of the opening functioning as a first blank pressing face;

a second die having a convex part, said second die forming a blank into a desired form in cooperation with said concave part; and a blank holder having a second blank pressing face, said blank holder working in such a way that said first blank pressing face and said second blank pressing face hold the blank between them while permitting it to flow into said concave part during pressing, wherein at least either of said first blank pressing face and said second blank pressing face has a roughened surface with a plurality of striated projections which are formed around the entire circumference of the edge of the opening of said concave part, and entirely extending in a direction inclined in a range of −25° to +25° toward the circumferential direction of the edge of the opening of said concave part, and wherein said roughened surface has a surface roughness (Ra) of 0.02–60 μm measured in a direction perpendicular to the circumferential direction of the edge of the opening of said concave part.

2. The press die as defined in claim 1, wherein said striated projections are formed in the direction inclined in a range of −15° to +15° toward the circumferential direction of the edge of the opening of said concave part.

3. The press die as defined in claim 2, wherein said striated projections are formed in the direction inclined in a range of −10° to +10° toward the circumferential direction of the edge of the opening of said concave part.

4. The press die as defined in claim 1, wherein said roughened surface has a surface roughness (Ra) of 0.1–40 μm measured in the direction perpendicular to the circumferential direction of the edge of the opening of said concave part.

5. The press die as defined in claim 4, wherein said roughened surface has a surface roughness (Ra) of 2–30 μm measured in the direction perpendicular to the circumferential direction of the edge of the opening of said concave part.

6. The press die as defined in claim 1, wherein said first blank pressing face has a roughened surface with a plurality of striated projections which are formed in the direction inclined in a range of −25° to +25° toward the circumferential direction of the edge of the opening of said concave part.

7. The press die as defined in claim 6, wherein said second blank pressing face has a roughened surface with a plurality of striated projections which are formed in the direction inclined in a range of −25° to +25° toward the circumferential direction of the edge of the opening of said concave part.

* * * * *

UNITED STATES PATENT AND TRADEMARK OFFICE

CERTIFICATE OF CORRECTION

PATENT NO. : 6,807,838 B2
DATED : October 26, 2004
INVENTOR(S) : Iwaya

It is certified that error appears in the above-identified patent and that said Letters Patent is hereby corrected as shown below:

Title page,
Item [73], Assignee, should read:
-- [73] Assignee Kabushiki Kaisha Kobe Seiko Sho (Kobe Steel, Ltd.) Kobe-shi (JP) --

Signed and Sealed this

Fifteenth Day of February, 2005

JON W. DUDAS
*Director of the United States Patent and Trademark Office*